US006802105B2

(12) United States Patent
Polowinczak et al.

(10) Patent No.: US 6,802,105 B2
(45) Date of Patent: Oct. 12, 2004

(54) SPRING BALANCE ASSEMBLY

(75) Inventors: Allen D. Polowinczak, Plainfield, IL (US); Mark V. Murphy, Oak Park, IL (US); James G. Prete, Chicago, IL (US)

(73) Assignee: Ashland Products, Inc., Lowell, IN (US)

( * ) Notice: Subject to any disclaimer, the term of this patent is extended or adjusted under 35 U.S.C. 154(b) by 0 days.

(21) Appl. No.: 10/194,445

(22) Filed: Jul. 12, 2002

(65) Prior Publication Data

US 2004/0006845 A1 Jan. 15, 2004

(51) Int. Cl.[7] ..... E05F 1/14; E05F 3/18

(52) U.S. Cl. ..... 16/198; 16/76; 16/DIG. 16; 49/446

(58) Field of Search ..... 16/76, 193, 197–198, 16/DIG. 16; 49/445–446; 188/65.1; 24/530–563

(56) References Cited

U.S. PATENT DOCUMENTS

| | | | | | |
|---|---|---|---|---|---|
| 1,226,843 | A | | 5/1917 | Arvine | |
| 1,699,341 | A | * | 1/1929 | Appleby | 16/198 |
| 1,965,478 | A | | 7/1934 | Smith | |
| 2,067,164 | A | | 1/1937 | Smith | |
| 2,112,650 | A | * | 3/1938 | Girard | 16/198 |
| 2,164,654 | A | * | 7/1939 | Kersting | 16/198 |
| 2,191,959 | A | * | 2/1940 | Hirsh | 16/198 |
| 2,581,423 | A | * | 1/1952 | Lustig | 16/198 |
| 2,609,193 | A | | 9/1952 | Foster | |
| 2,635,282 | A | * | 4/1953 | Trammell, Sr. et al. | 16/197 |
| 2,684,499 | A | | 7/1954 | Lewis | |
| 2,817,872 | A | | 12/1957 | Foster | |
| 2,992,450 | A | * | 7/1961 | Pittenger | 16/78 |
| 3,150,420 | A | * | 9/1964 | Brenner | 49/445 |
| 3,445,964 | A | | 5/1969 | Foster | |
| 3,452,480 | A | | 7/1969 | Foster | |
| 3,478,384 | A | | 11/1969 | Skolnik | |
| 3,533,127 | A | * | 10/1970 | Hoober | 16/76 |
| 3,711,995 | A | | 1/1973 | Anderson | |
| 3,820,193 | A | | 6/1974 | Foster | |
| 3,869,754 | A | | 3/1975 | Foster | |
| 3,992,751 | A | | 11/1976 | Foster et al. | |
| 4,028,849 | A | | 6/1977 | Anderson | |
| 4,227,345 | A | | 10/1980 | Durham, Jr. | |
| 4,363,190 | A | | 12/1982 | Anderson | |
| 4,570,381 | A | | 2/1986 | Sterner, Jr. | |
| 4,594,813 | A | | 6/1986 | Sterner, Jr. | |
| 4,683,676 | A | | 8/1987 | Sterner, Jr. | |

(List continued on next page.)

OTHER PUBLICATIONS

Ashland Products brochure for "PivotTrue Interlocking Pivot/Balance System," undated.

*Primary Examiner*—Daniel P. Stodola
*Assistant Examiner*—Christopher Boswell
(74) *Attorney, Agent, or Firm*—Wallenstein Wagner & Rockey, Ltd.

(57) ABSTRACT

The present invention provides a spring balance assembly for use with a sash window. The spring balance assembly comprises a plate, clip, pivot brake assembly, and first and second coil springs. The plate has a first portion, second portion, and a generally perpendicular transition portion thereby defining a cavity proximate the first portion. The cavity accommodates hardware mounted to the sash window during sliding movement of the sash window. The first coil spring is rotatably supported on a first spool and the second coil spring is rotatably supported on a second spool. A lower end of the first spring is connected to an attaching element of the clip. A lower end of the second spring is connected to a first wall of the pivot brake assembly and the clip is connected to the first wall to secure the first and second springs to the pivot brake assembly.

37 Claims, 8 Drawing Sheets

U.S. PATENT DOCUMENTS 4,694,552 A 9/1987 Ecker et al.
4,763,447 A * 8/1988 Haltof et al. ..... 49/445
4,935,987 A 6/1990 Sterner, Jr.
4,953,258 A 9/1990 Mennuto
4,958,462 A 9/1990 Cross
4,961,247 A 10/1990 Leitzel et al.
5,119,591 A 6/1992 Sterner, Jr. et al.
5,140,769 A 8/1992 Hickson et al.
5,152,032 A 10/1992 Davis et al.
5,157,808 A 10/1992 Sterner, Jr.
5,210,976 A 5/1993 Cripps
5,232,208 A 8/1993 Braid et al.
5,251,401 A 10/1993 Prete et al.
5,353,548 A 10/1994 Westfall
5,365,638 A 11/1994 Braid et al.
5,371,971 A 12/1994 Prete
5,377,384 A 1/1995 Riegelman
5,463,793 A 11/1995 Westfall
5,632,117 A 5/1997 Prete et al.
5,661,927 A 9/1997 Polowinczak et al.
5,806,243 A 9/1998 Prete et al.
5,924,243 A 7/1999 Polowinczak et al.
6,119,398 A 9/2000 Yates, Jr.
6,183,024 B1 2/2001 Schultz et al.
6,378,169 B1 * 4/2002 Batten et al. ..... 16/197
2002/0116786 A1 * 8/2002 Guillemet et al. ..... 16/197

* cited by examiner

SPRING BALANCE ASSEMBLY

CROSS-REFERENCE TO RELATED APPLICATIONS

Not Applicable.

FEDERALLY SPONSORED RESEARCH OR DEVELOPMENT

Not Applicable.

TECHNICAL FIELD

The present invention relates to a spring balance assembly for a sash window. More specifically, the present invention relates to a spring balance assembly with stacked or tandem coil springs that increases the operating range and egress of the sash window.

BACKGROUND OF THE INVENTION

Sash windows disposed within a master frame are quite common. Generally, the master frame includes a pair of opposed vertical guide rails, an upper horizontal member or header, and a lower horizontal member or base. The guide rails are designed to slidingly guide at least one sash window within the master frame. For double hung sash windows, a common window configuration, the guide rails define an elongated channel. To counterbalance the sash window during movement of the window, a spring balance assembly is affixed to the master frame in the elongated channel and connected to the sash window. Due to its structural configuration, conventional spring balance assemblies are generally positioned below the midpoint of the master frame. The spring balance assemblies must be affixed below the midpoint because their structure will interfere with the hardware mounted to the sash window during the sliding movement of the sash window. Specifically, the structure of the spring balance assembly, for example the plastic plate that houses the coil springs, will make contact with a latch bolt of a tilt-latch mounted on the sash window during movement of the sash window if the spring balance assembly is affixed at or above the midpoint of the master frame. Accordingly, to prevent contact and interference during the sliding movement of the sash window, the spring balance assembly must be mounted below the midpoint of the master frame. As a result, the operating range or lift height of the sash window is diminished thereby reducing the egress through the sash window.

In addition, conventional spring balance assemblies exhibit a limitation regarding the manner in which the coil springs are connected to the pivot brake assembly. Typically, a threaded fastener is utilized to connect the coil springs to a portion of a pivot brake assembly that pivotally supports the sash window. The fastener is inserted through an opening in the lower portion of the coil spring and received by an aperture of the pivot brake assembly. The use of a threaded fastener presents problems when the coil springs have different sizes, primarily different widths, because the openings in the coil springs are not aligned when the coil springs overlap to connect the springs to the same portion of the pivot brake assembly. Improper alignment of the coil springs produces undesirable noise during the operation of the coil springs and the spring balance assembly. In addition, improper alignment introduces a horizontal force component to the movement of the coil springs which negatively affects the performance and durability of the spring balance assembly.

An example of a spring balance assembly susceptible to the limitations identified above is found in U.S. Pat. No. 4,961,247 to Leitzel et al. Referring to FIG. 4 therein, the first balance assembly 1A is positioned in the elongated channel 35 of guide rail 34 a significant distance from the junction point or jamb head 36. In addition, the second balance assembly 1B is positioned in the elongated channel 37 of guide rail 32 above the first balance assembly 1A but still a considerable distance from the jamb head 36. As shown in FIGS. 1–3, the spring holder 6 has a generally linear configuration that requires the balance assemblies 1A,B to be positioned below the midpoint of the channel 35, 37. Consequently, the operating range of the balance assemblies 1A,B and the sash window are limited.

Therefore, there is a need for a spring balance assembly that can be affixed to the master frame at a higher vertical position of the master frame to increase the operating range and egress characteristics of the sash window. In addition, there is a need for a spring balance assembly having an interface means for securing different sized coil springs to the pivot brake assembly while ensuring the proper alignment of the coil springs. The present invention is provided to solve these and other deficiencies.

SUMMARY OF THE INVENTION

The present invention relates to a spring balance assembly for use with a sash window. The spring balance assembly comprises a plate, a pivot brake assembly, a clip, a first coil spring, and a second coil spring. The plate has a first portion, a second portion, and a transition wall. The transition wall is positioned between the first and second portions thereby creating a step or ledge between the portions. The stepped or staggered configuration of the plate enables the spring balance assembly to accommodate the hardware of the sash window during sliding movement of the window thereby allowing the spring balance assembly to be positioned at or above a midpoint of the master frame. As a result, the lift height and operating range of the sash window is increased and egress through the window is enhanced.

The spring balance assembly comprises a plate having a first portion, a second portion, and a transition portion or wall. The transition wall is positioned between the first and second portions thereby creating a step or ledge between the portions. A top wall extends from an upper edge of the first portion and towards an inner surface of the master frame. The plate has a length, thickness, and width which can be varied depending upon the design parameters of the spring balance assembly.

In accord with the invention, a first spool adapted to support a first coil spring extends generally perpendicular from the first portion. Similarly, a second spool adapted to support a second coil spring extends generally perpendicular from the second portion. The first and second spools rotatably support the first and second springs but do not bind or inhibit the rotation of the springs. Preferably, each spool is tubular thereby defining an elongated passageway. A fastener is inserted into one or both passageways to secure the spring balance assembly to the master frame within the channel. A first rotatable drum can be positioned between the first spool and the first spring. A second rotatable drum can be positioned between the second spool and the second spring.

The first spring has an upper or coiled end that is coiled about the first spool, and a lower or free end that is connected to a portion of a pivot brake assembly. Similarly, the second spring has an upper or coiled end that is coiled about the second spool, and a lower end that is connected to a portion of the pivot brake assembly. The pivot brake assembly is operably connected to a lower portion of the sash window near the base rail. When the pivot brake assembly is coupled to the sash window the spring balance assembly counterbalances the weight of the sash window wherein the first and second springs exert a generally upward force on the sash window.

The spring balance assembly further includes an interface means or clip. In general terms, the clip is adapted to connect the first spring and the second spring to the pivot brake assembly. The clip has a first attaching element adapted to engage an opening in the free end of the first spring and a second attaching element adapted to engage an opening of the second spring. An aperture is positioned in a depending region of the clip and generally between the first and second attaching elements. A portion of the clip is received by a recess in a first wall of the pivot brake assembly. A fastener is employed to secure the clip to the pivot brake assembly. The fastener can be a screw, rivet, or any elongated structure capable of securing the clip, the first or second springs, and the pivot brake assembly.

In further accord with the invention, the spring balance assembly has a cavity proximate the first portion of the plate. The cavity has a generally rectangular configuration resulting from the stepped or staggered configuration of the plate. The cavity is adapted to provide clearance for the nose portion of the bolt of the latch bolt hardware mounted to the sash window. The spring balance assembly is affixed to the master frame with a portion of the assembly positioned above the midpoint of the master frame. When the spring balance assembly is affixed at or above the midpoint, the cavity receives the nose portion of the bolt. When the sash window is moved in a generally vertical and upward direction from the closed position to an open position, the nose of the bolt moves from a lower portion of the cavity through an upper portion of the cavity. In this manner and in contrast to conventional devices, the cavity accommodates the sliding movement of the nose portion of the bolt. Similarly, the cavity further accommodates the sliding movement of the nose of the bolt 21 when the sash window is moved from the open position to the closed position. The accommodation of the bolt permits the spring balance assembly to be affixed to the master frame with a portion above the midpoint of the master frame. Thus, the position of the spring balance assembly affects the operating range of the sash window.

In another embodiment shown, the spring balance assembly comprises a plate with a first portion, a second portion, and a transition wall. The transition wall is positioned between the first and second portions thereby creating a step or ledge between the portions. A top wall extends from a top edge of the first portion and towards an inner surface of the master frame. In this embodiment, the clip is omitted from the spring balance assembly and as a result, the first spring and second spring are connected directly to the pivot brake assembly to define an assembled position. In the assembled position, the first spring is connected to the second wall of the pivot brake assembly, and the second spring is connected to the first wall of the pivot brake assembly. The first and second springs rotate in opposite directions. For example, when the first spring rotates in a counter-clockwise direction, the second spring rotates in a clockwise direction.

Other features and advantages of the invention will be apparent from the following specification taken in conjunction with the following drawings.

DETAILED DESCRIPTION OF THE INVENTION

Figure 1:
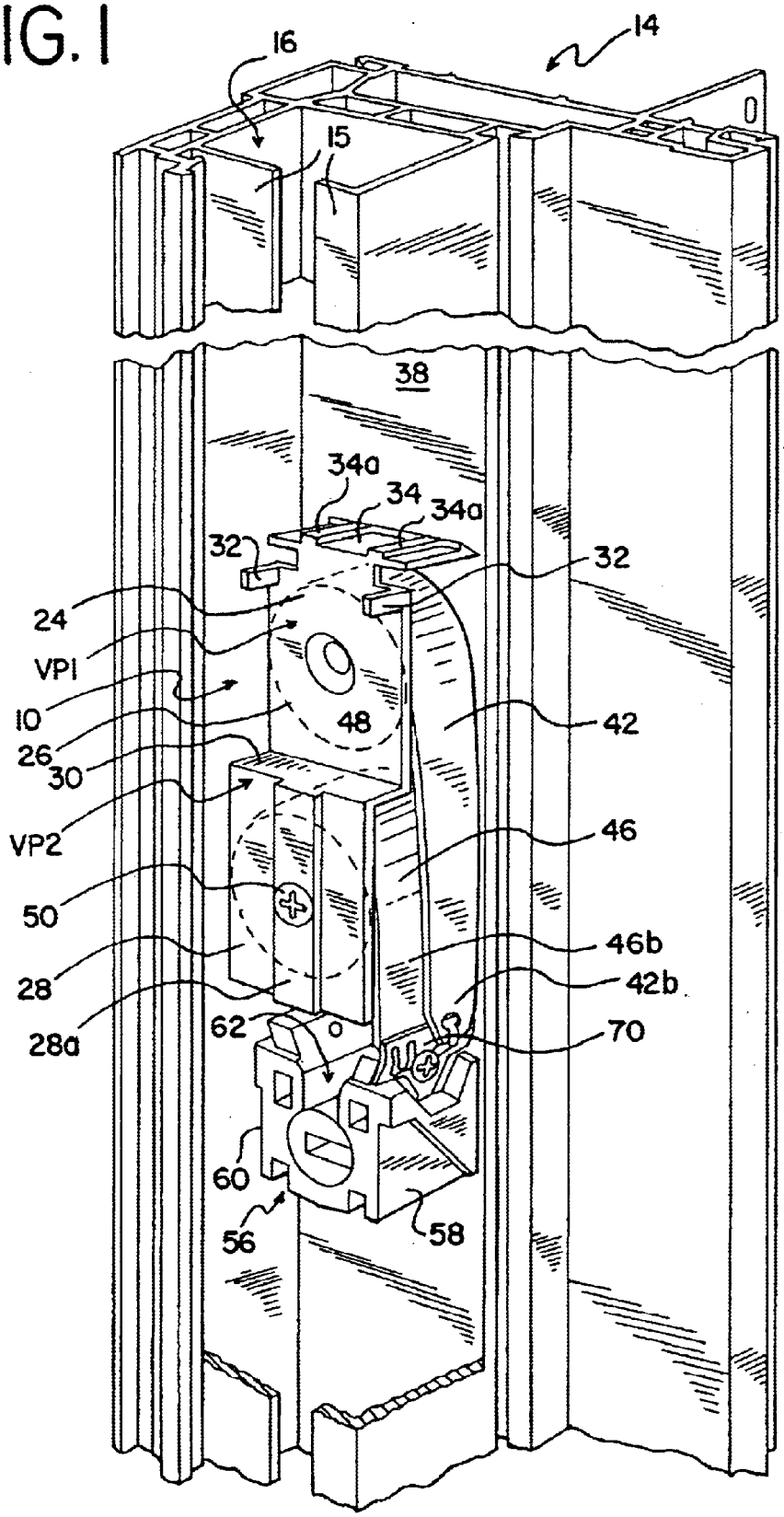
FIG. 1 is a partial perspective view of a spring balance assembly of the invention, showing the spring balance assembly connected to a master frame.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
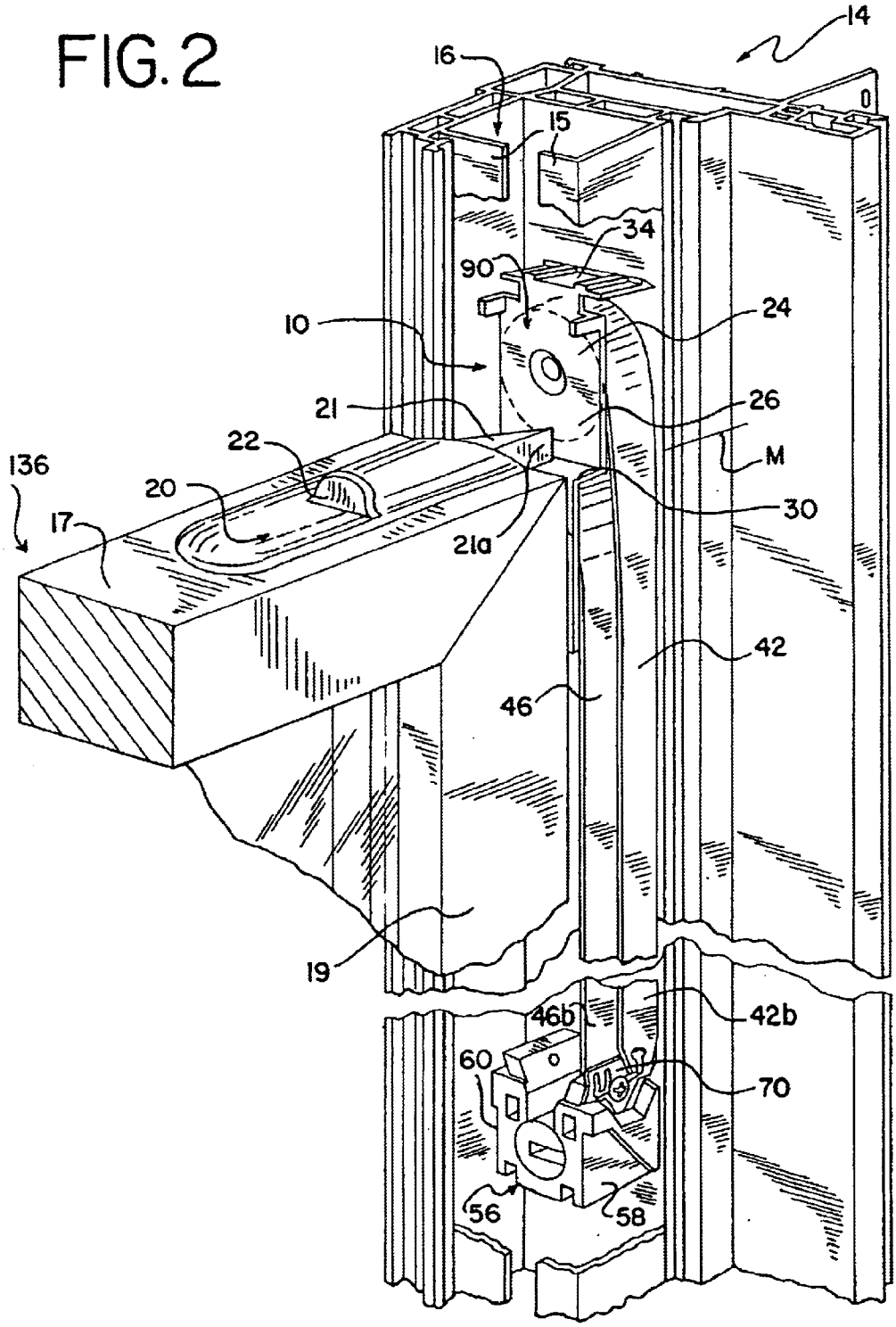
FIG. 2 is a partial perspective view of the spring balance assembly of FIG. 1, showing the interaction between the spring balance assembly and a sash window having a tilt-latch.
Figure 3A:
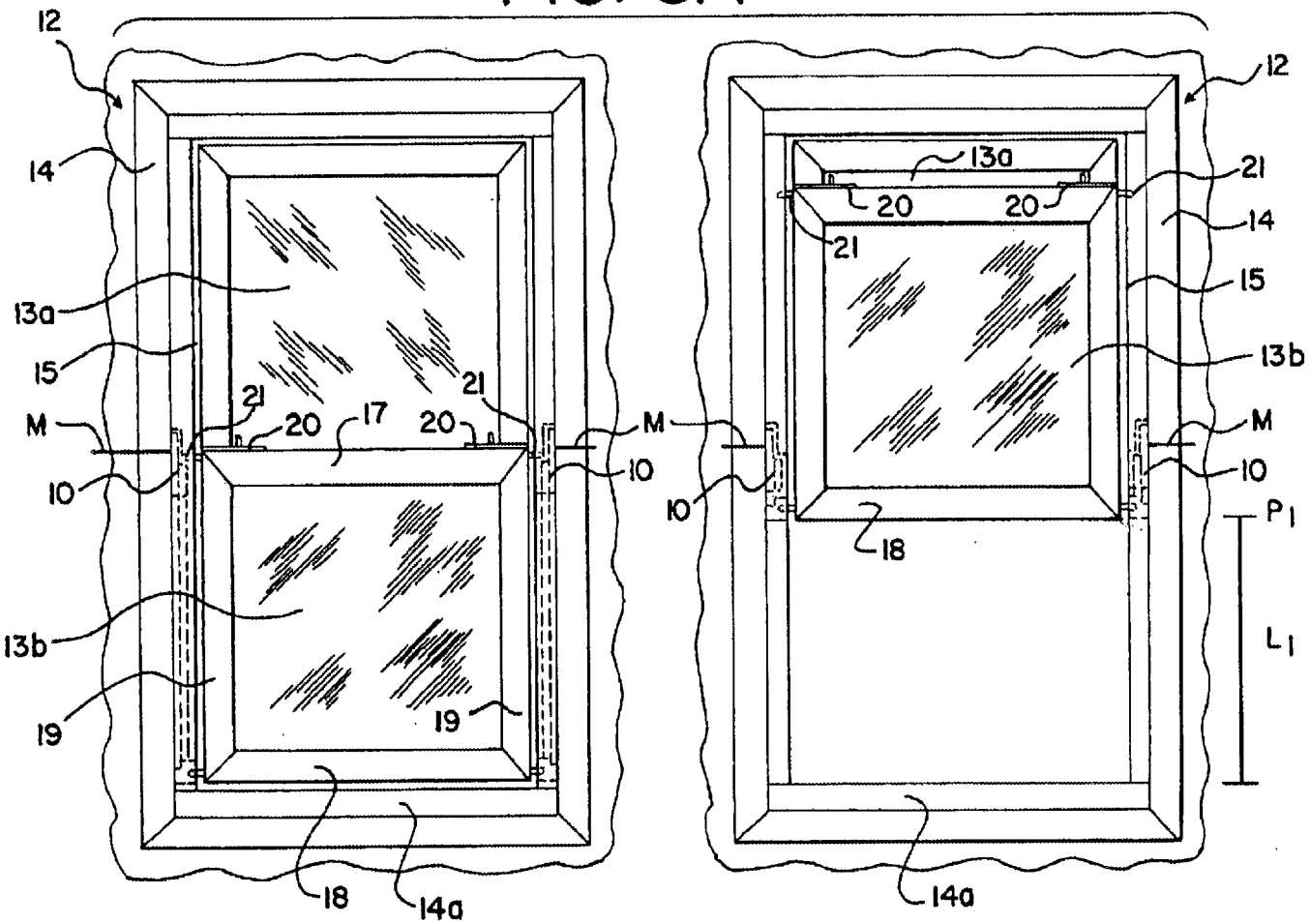
FIG. 3A is a front elevation view of the spring balance assembly of FIG. 1, showing the spring balance assembly installed in a master frame.

Referring to FIGS. 1–3, a spring balance assembly 10 is affixed to a sash window assembly 12. The sash window assembly 12 shown in FIG. 3 is a double-hung window assembly having an upper pivotal sash window 13*a* and a lower pivotal sash window 13*b* in a master frame 14. In general terms, the master frame 14 includes a pair of opposed vertical guide rails 15 adapted to slidably guide the sash windows 13*a,b*. The master frame further includes a footer or lower horizontal element 14*a*. The guide rail 15 defines an elongated channel 16 in which the spring balance assembly 10 is mounted. Typically, the master frame 14 has a set of guide rails 15 for each sash window 13*a,b* and the spring balance assembly 10 is mounted to each guide rail 15 to balance the sash window 13*a,b*.

The sash window 13*b* has a top rail 17, a base rail 18, and a pair of stiles or side rails 19. Referring to FIG. 2, a tilt latch 20 is mounted in an upper portion of the top rail 17. The tilt latch 20 has a bolt 21 with a nose portion 21 a adapted to extend into the elongated channel 16. The tilt latch 20 has an actuator 22 and a spring (not shown) wherein the actuator 22 is designed to retract the bolt 21 into the housing of the latch 20 against the biasing force of the spring.

Figure 4:
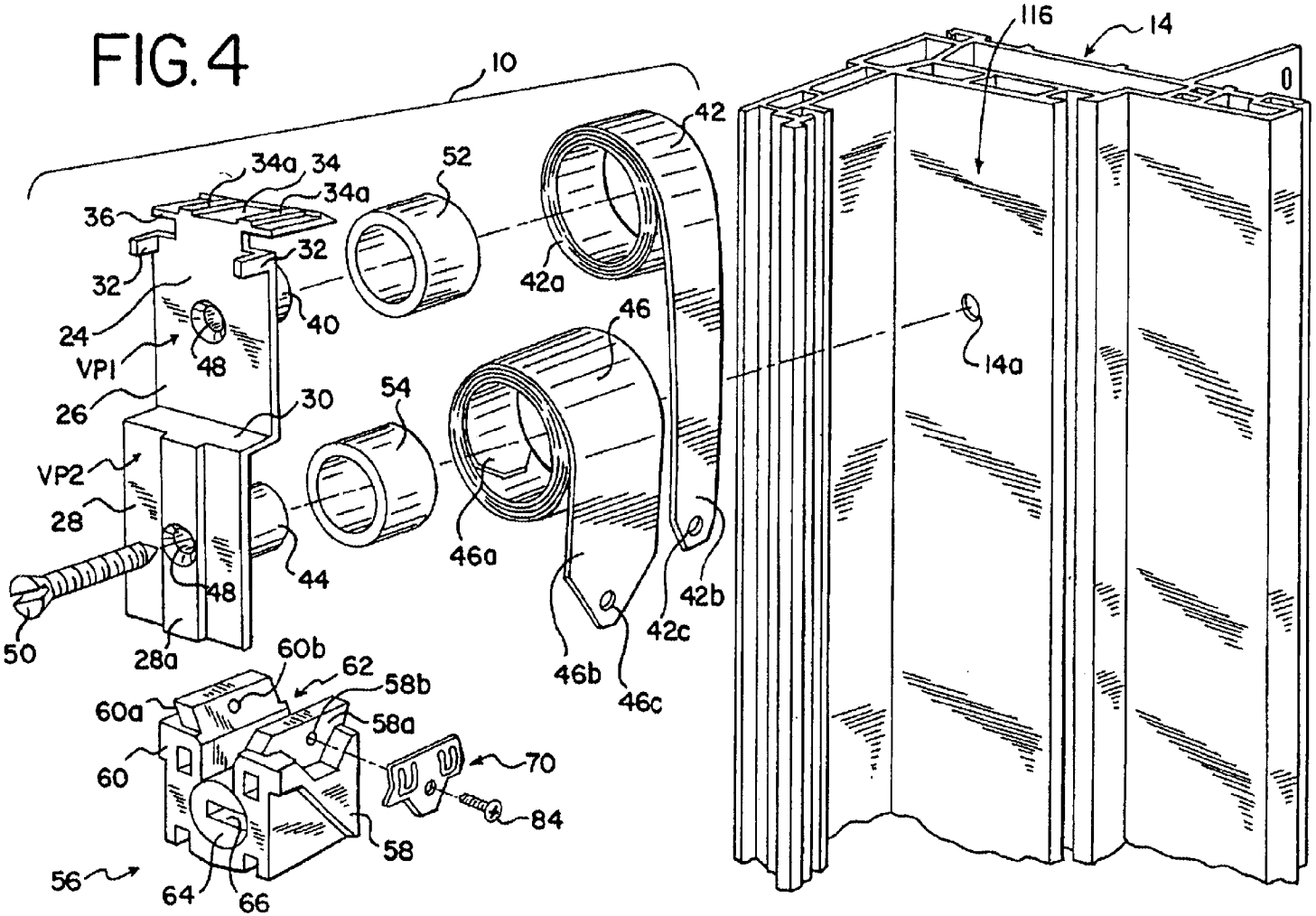
FIG. 4 is an exploded view of the spring balance assembly of FIG. 1.

As shown in FIGS. 1, 2, and 4, the spring balance assembly 10 comprises a plate 24 having a first portion 26, a second portion 28, and a transition portion or wall 30. The transition wall 30 is positioned between the first and second portions 26, 28 thereby creating a step or ledge between the portions 26, 28. Described in a different manner, the first portion 26 has a surface 26*a* that is laterally offset from a surface 28*a* of the second portion 28 thereby creating a plate 24 with a staggered configuration. Moreover, the first surface 26*a* defines a first, substantially vertical plane VP1 that is not aligned with a second, substantially vertical plane VP2 defined by the second surface 28*a*. Although shown as being generally perpendicular to the first and second portions 26, 28, the transition wall 30 can be angled or sloped. A pair of arms 32 extend from an upper region of the first portion 26. A top wall 34 extends from an upper edge 36 of the first portion 26 and towards an inner surface 38 of the channel 16. The top wall 34 includes a pair of ribs 34*a* which are adapted to increase the rigidity of the spring balance assembly 10. Also, the ribs 34*a* facilitate the stacking of additional balance assemblies on the top wall 34. The second portion 28 has a raised strip 28*a* which is adapted to increase the structural rigidity of the plate 24 and spring balance assembly 10. The plate 24 has a length, thickness, and width which can be varied depending upon the design parameters of the spring balance assembly 10.

Figure 5:
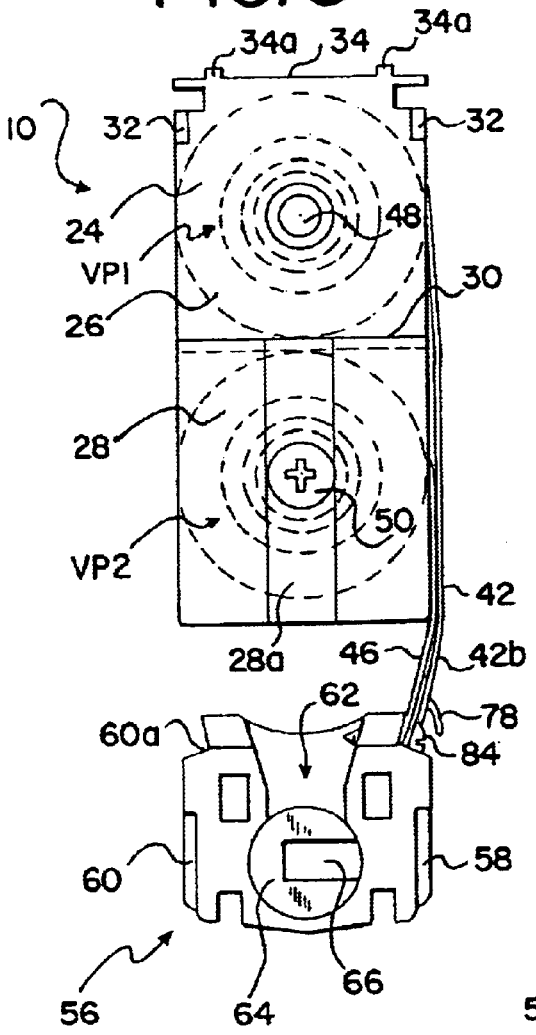
FIG. 5 is a front elevation view of the spring balance assembly of FIG. 1.
Figure 6:
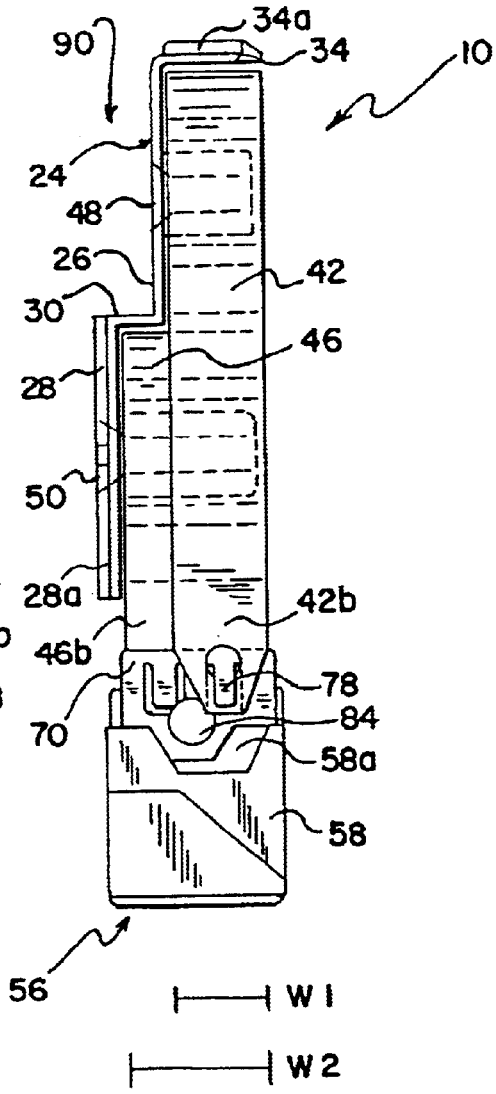
FIG. 6 is a side elevation view of the spring balance assembly of FIG. 1.

Referring to FIGS. 4–6, a first spool 40 adapted to support a first coil spring 42 extends generally perpendicular from the first portion 26. Similarly, a second spool 44 adapted to support a second coil spring 46 extends generally perpendicular from the second portion 28. The first and second spools 40, 44 rotatably support the first and second springs 42, 46 but do not bind or inhibit the rotation of the springs 42, 46. Each spool 40, 44 has a diameter, and length, which can be varied with the design parameters of the spring balance assembly 10, including the respective diameters of the springs 42, 46. Preferably, each spool 40, 44 is tubular thereby defining an elongated passageway 48. A fastener 50 is inserted into one or both passageways 48 to secure the spring balance assembly 10 to the master frame 14 within the channel 16. An extent of the fastener 50 is received by an aperture 14*a* in the master frame 14. Note that the guide rail 15 has been omitted from the master frame 14 in FIG. 4 for illustrative purposes. The fastener 50 can be a screw, rivet, or any elongated structure capable of securing the spring balance assembly 10 to the master frame 14.

A first rotatable drum 52 can be positioned between the first spool 40 and the first spring 42. A second rotatable drum 54 can be positioned between the second spool 44 and the second spring 46. Preferably, the first and second drums 52, 54 are tubular structures adapted to facilitate the rotation of the springs 42, 46. In addition, the drums 52, 54 can reduce the noise generated by the springs 42, 46 during rotation.

The first spring 42 has an upper or coiled end 42*a* that is coiled about the first spool 40, and a lower or free end 42*b* that is connected to a portion of a pivot brake assembly 56. Similarly, the second spring 46 has an upper or coiled end 46*a* that is coiled about the second spool 44, and a lower end 36*b* that is connected to a portion of the pivot brake assembly 56. The pivot brake assembly 56 is operably connected to a lower portion of the sash window 13*b* near the base rail 18. When the pivot brake assembly 56 is coupled to the sash window 13*b* the spring balance assembly 10 counterbalances the weight of the sash window 13*b* wherein the first and second springs 42,46 exert a generally upward force on the sash window 13*b*. The pivot brake assembly 56 has a first wall 58 and a generally opposed second wall 60. A central cavity 62 is defined generally between the first and second walls 58, 60. A cam 64 is positioned below the cavity 62 and has a generally rectangular slot 66. Referring to FIG. 5, the pivot brake assembly 56 has width that is generally equal to the width of the plate 24.

Figure 7:
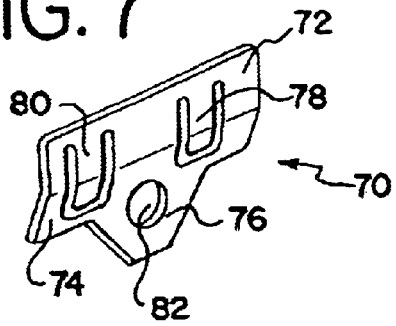
FIG. 7 is a perspective view of a clip used in the spring balance assembly of FIG. 1.

The spring balance assembly 10 further includes an interface means or clip 70. In general terms, the clip 70 is adapted to connect the first spring 42 and the second spring 44 to the pivot brake assembly 56. Referring to FIG. 7, the clip 70 has a body having a first portion 72, second portion 74, and a nose or depending portion 76. The first portion 72 has an attaching element or finger 78 adapted to engage an opening 42*c* in the free end 42*b* of the first spring 42. The second region 74 has an attaching element or finger 80 adapted to engage an opening 46*c* of the second spring 46 or an opening in a third spring (not shown). Preferably, the first and second fingers 78, 80 extend from the first and second portions 72, 74, respectively. An aperture 82 is positioned in the depending region 76 and generally between the first and second regions 72, 74. As shown in FIGS. 1, 2, and 4–6, a portion of the clip 70 is received by a recess 58*a* in the first wall 58 of the pivot brake assembly 56. Accordingly, the clip 70 and the recess 58*a* are cooperatively dimensioned such that the clip 70 can be affixed to the first wall 58 at the recess 58*a*. Alternatively, the clip 70 is received by a recess 60*a* in the second wall 60 of the pivot brake assembly 56. A fastener 84 is employed to secure the clip 70 to the pivot brake assembly 56. The fastener 84 can be a screw, rivet, or any elongated structure capable of securing the clip 70, the first or second springs 42, 46, and the pivot brake assembly 56. In a preferred embodiment, the clip 70 is formed from metal, plastic, or other suitable materials.

Referring to FIG. 6, the first spring 42 has a width W1, and the second spring 46 has a width W2. The width W1 of the first spring 42 is roughly equivalent to the dimensions of the top wall 34 of the plate 24. Preferably, the width W2 of the second spring 46 exceeds the width W1 of the first spring 42 and is roughly equivalent to the clip 70 or slightly less than the width of the pivot brake assembly 56. In an assembled position of FIG. 6, the second spring 46 is positioned behind the first spring 42. Since the width W2 of the second spring 46 is greater, the springs 42, 46 overlap such that a portion of the second spring 46 is visible as being behind the first spring 42. Alternatively, a smaller second spring 46 can be employed in the spring balance assembly 10 wherein the width W2 of the second spring 46 is roughly equivalent to the width WI of the first spring 42. In this configuration, the springs 42, 46 overlap but the visibility of the second spring 46 is reduced. The ability to accept varying widths of springs 42, 46 increases the versatility, utility, and value of the spring balance assembly 10 since the counterbalance force applied to the sash window can be varied.

In the configuration where the second spring 46 has a greater width than the first spring 42 (W2>W1), the fastener 84 extends through the aperture 82 in the clip 70, the opening 46*c* of the second spring 34, and an opening 58*b* of the first wall 58. Referring to FIG. 5, the first spring 42 is secured by the engagement between the first attaching member 78 and the aperture 42*c* of the free end 42*b* of the first spring 42. In this manner, the attaching member 78 extends from the pivot brake assembly 56. Alternatively and referring to FIG. 6, the rivet fastener 84 is dimensioned such that it overlaps an extent of the free end 42*b* to further secure the engagement between the clip 70 and the first spring 42. The diameter of the rivet fastener 84 of FIG. 6 can be further increased to cover or overlap a portion of the attaching element 78. In this manner, the attaching member 78 does not extend from the pivot brake assembly 56. In the configuration where the first and second springs 42,46 have the same widths (W1=W2), for example ½ inch, the free end 46 of the second spring 46 is secured to the pivot brake assembly 56 by engagement between the opening 46*c* and the second attaching element 80. In this manner, the free end 42*c* of the first spring 42 engages the attaching element 78 and the second spring 34 engages the attaching element 80 while the fastener 84 secures the clip 70 to the pivot brake assembly 56.

When the spring balance assembly 10 is in the assembled position (see FIGS. 1, 2, 5, and 6), the first spring 42 is secured to the pivot brake assembly 56 by engagement between the opening 42*c* and the attaching element 78 of the clip 70. The clip 70 is configured to maintain the alignment of the first and second springs 42,46 with respect to the plate 34, spools 42, 44, and the pivot brake assembly 56 during the installation and operation of the spring balance assembly 10. Proper alignment between these elements reduces the tendency of the first and second springs 42, 46 to bind or squeal during operation of the spring balance assembly 10. Thus, the clip 70 provides an efficient and compact means for affixing the first and second springs 42, 46 to the pivot brake assembly 56. In the assembled position, the nose portion 76 and an extent of the first and second portions 72, 74 of the clip 70 are received by the recess 58*a*. The specific amount or degree of the clip 70 that is received by the recess 58*a* varies with the design parameters of the spring brake assembly 10.

Referring to FIGS. 1, 2, 4, and 6, the spring balance assembly 10 has a cavity 90 proximate the first portion 26 of the plate 24. The cavity 90 has a generally rectangular configuration resulting from the stepped or staggered configuration of the plate 24. The lower boundary of the cavity 90 generally corresponds to the transition wall 30. The cavity 90 is adapted to provide clearance for the nose portion 21*a* of the bolt 21 of the latch bolt 20. As shown in FIG. 2, the spring balance assembly 10 is affixed to the master frame 14 with a portion of the assembly 10 positioned above the midpoint M of the master frame 14. The midpoint M is the point where the guide rail 15 and the channel 16 are divided into equal halves. When the spring balance assembly 10 is affixed at the midpoint M, the cavity 90 receives the nose portion 21*a* of the bolt 21. The sash window assembly 13 is in the closed position in the first portion of FIG. 3A and in the open position in the second portion of FIG. 3A. As shown in FIG. 2 and the first portion of FIG. 3A, the nose portion 21*a* extends a distance into the cavity 90 and the nose portion 21*a* is positioned slightly above the transition wall 30. In the closed position, the first and second springs 42, 46 are extended such that the free ends 42*b*, 46*b* are positioned near the base rail 18 of the sash window 13*b*. The nose 21*a* is configured to extend between the flanges or shoulders of the guide rail 15 and into the cavity 90. When the sash window 13*b* is moved in a generally vertical and upward direction from the closed position to an open position (see the second portion of FIG. 3A), the nose 21*a* moves from a lower portion of the cavity 90 through an upper portion of the cavity 90. Described in different terms, the nose 21*a* moves within the cavity 90 from the transition wall 30 past to the top wall 34. In this manner and in contrast to conventional devices, the cavity 90 accommodates the sliding movement of the nose portion 21*a* of the bolt 21. Similarly, the cavity 90 further accommodates the sliding movement of the nose 21*a* of the bolt 21 when the sash window 13*b* is moved from the open position to the closed position. The accommodation of the bolt 21 permits the spring balance assembly 10 to be affixed to the master frame 14 with a portion above the midpoint M of the master frame 14. Specifically, the spring balance assembly 10 is affixed such that the upper portion 26 is positioned above the midpoint M or above the top rail 17 of the sash window 13*b*. In the open position of the second portion of FIG. 3A, the base rail 18 of the sash window 13*b* is located at position P1 and at a distance L1 from the footer 14*a* of the master frame 14. The distance L1 generally represents the operating range of the sash window 13*b* and corresponds to the degree of egress through the sash window 13*b*. At position P1, the pivot brake assembly 56 and the free ends 42*c*, 46*c* of the first and second springs 42, 46 are located near the second portion 28 of the plate 24. Thus, the position of the spring balance assembly 10 affects the operating range of the sash window 13*b*—positioning the spring balance assembly 10 at or partially above the midpoint M increases the operating range, whereas positioning the spring balance assembly 10 below the midpoint M decreases the operating range of the sash window 13*b*.

Figure 3B:
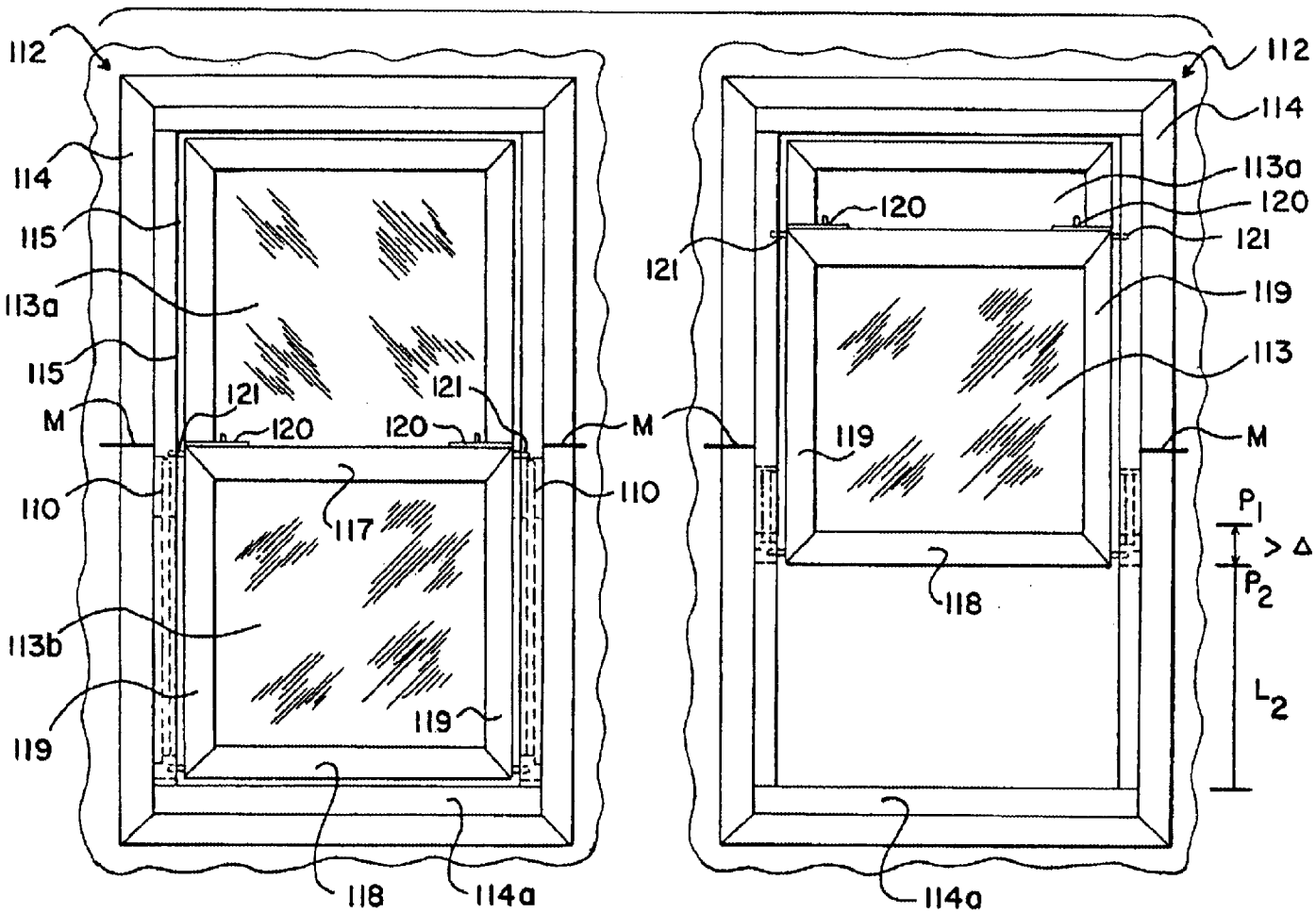
FIG. 3B PRIOR ART
FIG. 3B is a front elevation view of a prior art spring balance assembly, showing the prior art spring balance assembly installed in a master frame.

A conventional spring balance assembly 110 is mounted to a similar sash window assembly 113 shown in the FIG. 3B. The spring balance assembly 110 has a plate (not shown) with a linear configuration, meaning that the spring balance assembly 110 lacks a stepped configuration and the cavity 90 of the present invention. Due to its linear configuration, the conventional spring balance assembly 110 cannot accommodate the bolt 121 of the tilt latch 120 during the sliding movement of the sash window 113*b*. Consequently, the conventional spring balance assembly 110 must be positioned below the midpoint M of the master frame 114. Described in different terms, the conventional spring balance assembly 110 must be positioned below the top rail 117 of the sash window 13*b* because its structure cannot accommodate the movement of the bolt 121 of the tilt latch 120 during operation of the sash window 113*b*. The sash window assembly 113 is in the closed position in the first portion of FIG. 3B and in the open position in the second portion of FIG. 3B. In the open position of FIG. 3B, the bottom rail 118 is located at position P2 and at a distance L2 from the footer 114*a* of the master frame 114. The distance L2 generally represents the operating range of the sash window 113*b* and corresponds to the degree of egress through the sash window 113*b*. As FIGS. 3A and 3B clearly show, P1 is above P2—meaning that the bottom rail 18 is higher than the bottom rail 118. The difference between P1 and P2 is the operating range difference Δ which represents an increase in the egress of the sash window 13*b*. Similarly, the operating range difference Δ further represents in increase in the lift height of the sash window 13*b*. The increase in egress corresponds to an increase in the utility and value of the spring balance assembly 10. Due to its structure, primarily the cavity 90, the spring balance assembly 10 accommodates hardware mounted to the top rail 17 during the sliding movement of the sash window 13*b* (allowing the spring balance assembly 10 to be affixed above the midpoint M), thereby increasing the egress and operating range of the sash window 13*b*.

Figure 8:
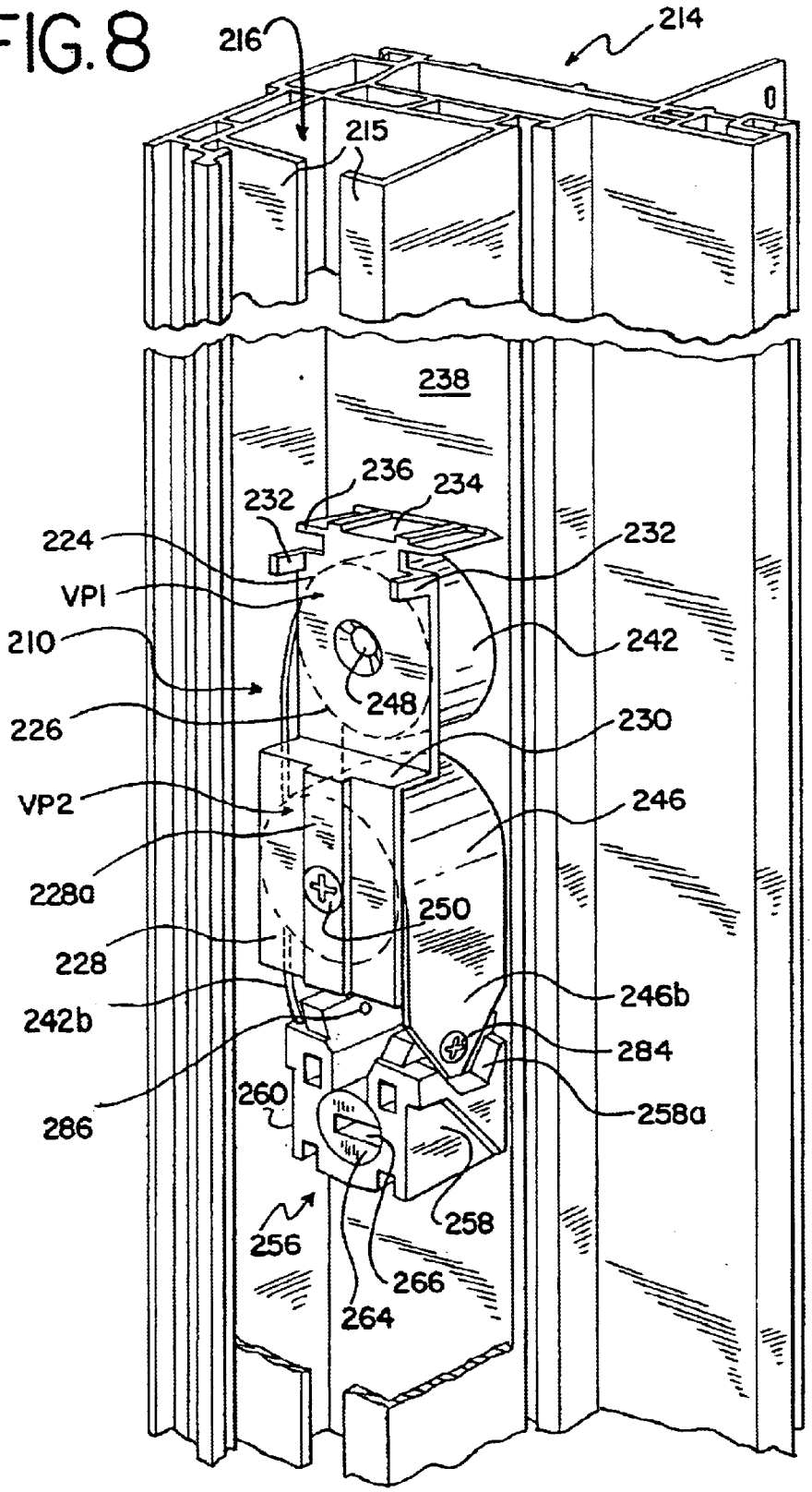
FIG. 8 is a partial perspective view of a second spring balance assembly of the invention.
Figure 9:
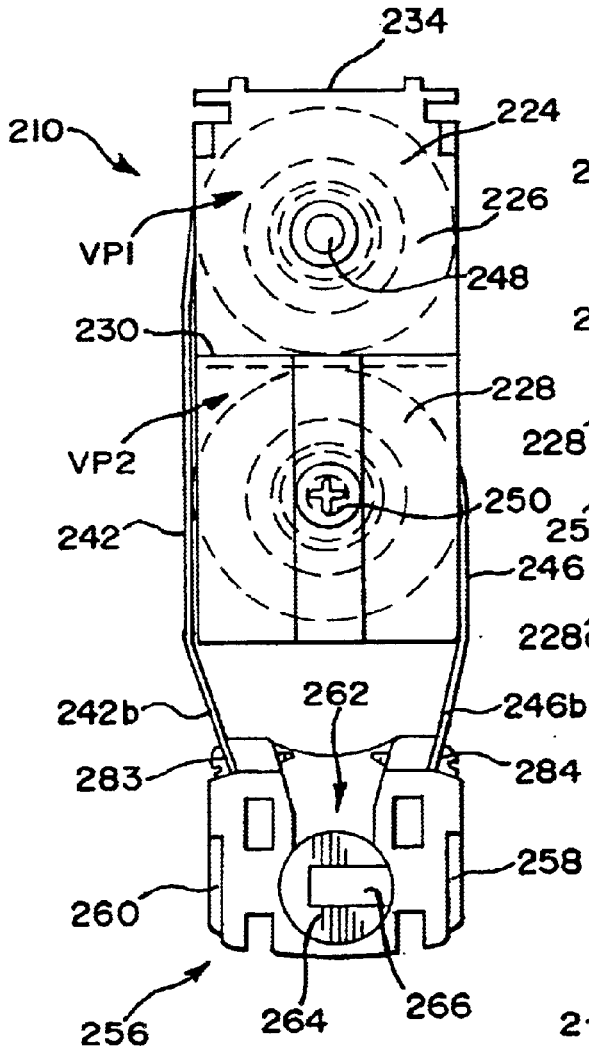
FIG. 9 is a front elevation view of the spring balance assembly of FIG. 6; and, FIG. 10 is a side elevation view of the spring balance assembly of FIG. 6.
Figure 10:
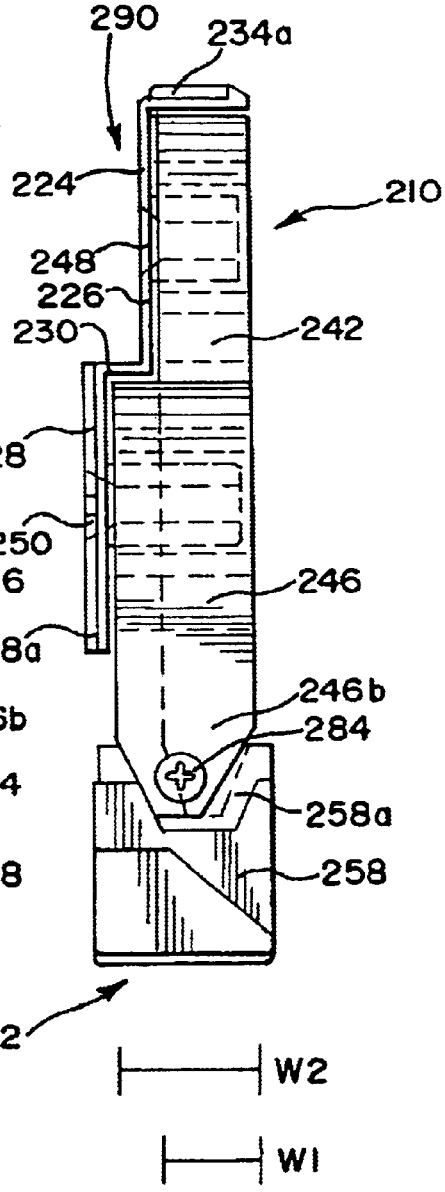

In another embodiment shown in FIGS. 8–10, the spring balance assembly 210 comprises a plate 224 with a first portion 226, second portion 228, and transition wall 230. The transition wall 230 is positioned between the first and second portions 226, 228 thereby creating a step or ledge between the portions 226, 228. A pair of arms 232 extend from an upper region of the first portion 226. A top wall 234 extends from a top edge 236 of the first portion 226 and towards an inner surface 238 of the master frame first channel 216. The top wall 234 includes a pair of ribs 234*a* which are adapted to increase the rigidity of the plate 224 and permit stacking of additional balance assemblies. The second portion 228 has a raised strip 228*a* which is adapted to increase the structural rigidity of the plate 224 and spring balance assembly 210. A first spool (not shown) adapted to support a first coil spring 242 extends generally perpendicular from the first portion 226. Similarly, a second spool (not shown) adapted to support a second coil spring 246 extends generally perpendicular from the second portion 228. Preferably, the first and second spools have a hollow core which defines an elongated passageway 248. A fastener 250 can be inserted into one or both passageway 248 to secure the spring balance assembly 210 to the guide rail 214.

In this embodiment, the clip 70 is omitted from the spring balance assembly 210. As a result, the first spring 242 and second spring 246 are connected directly to the pivot brake assembly 256 to define a use position. In the assembled position, the first spring 242 is connected to the second wall 260 of the pivot brake assembly 256, and the second spring 246 is connected to the first wall of 258 of the pivot brake assembly 256. Specifically, the lower end 242*b* of the first spring 242 is secured to a recess 260*a* of the second wall 260 by a fastener 283. Similarly, the lower end 246*b* of the second spring 246 is secured to a recess 258*a* of the first wall 258 by a fastener 284. The position of the aperture 286 (see FIG. 8) in the walls 258, 260 that receives the fastener 283,284 can be varied to meet the size of the springs 242, 246. This means that the aperture 286 can be off-center relative to the walls 258,260 to accommodate smaller or larger springs 242, 246

In the assembled position, the first and second springs 242, 246 rotate in opposite directions (see the arrows in FIG. 8). For example, when the first spring 242 rotates in a counter-clockwise direction, the second spring 246 rotates in a clockwise direction.

The spring balance assembly 10 of the present invention provides a number of significant advantages over conventional balance assemblies. First, due the stepped or notched configuration of the plate 24, the spring balance assembly 10 has a cavity 90 that accommodates the hardware, primarily the bolt 21 of the tilt latch 20, on the top rail 17 during the sliding movement of the sash window 13. As a result, the spring balance assembly 10 can be positioned in a generally higher position of the master frame 14 or above the midpoint M of the master frame 14. This means that when the sash window 13*b* is fully opened, the base rail 18 is higher than it would have been using a conventional spring balance assembly. Consequently, the operating range or lift height of the sash window 13*b* is increased and egress through the window is enhanced. Another benefit of the present invention relates to the ability of the clip 70 to secure springs 32, 34 having different widths to the spring balance assembly 10 without compromising or impeding the travel and operation of the springs 32, 34. Since the spring balance assembly 10 can accommodate different sized springs 32, 34, the versatility, utility, and value of the spring balance assembly 10 is increased.

While the specific embodiments have been illustrated and described, numerous modifications come to mind without significantly departing from the spirit of the invention and the scope of protection is only limited by the scope of the accompanying claims.

We claim:

1. A spring balance assembly for a sash window slidable within a master frame, the master frame having a channel, the spring balance assembly comprising:

a plate adapted to be attached to the master frame in the channel;

a coil spring having a coiled end and a free end, the coiled end supported on the plate;

a pivot brake assembly adapted to be positioned in the channel and further adapted to be attached to the sash window; and, a clip attached to the brake assembly, the clip having an attaching element, the free end of the spring connected to the attaching element.

2. The spring balance assembly of claim 1 wherein the attaching element comprises a finger that engages an aperture in the free end of the spring.

3. The spring balance assembly of claim 1 wherein a nose portion of the clip is received by a recess in the pivot brake assembly.

4. The spring balance assembly of claim 3 wherein the nose portion has an aperture and wherein a fastener is inserted through the aperture to connect the clip to the pivot brake assembly.

5. The spring balance assembly of claim 1 further comprising a spool extending from the plate, the coil spring rotatably supported by the spooi.

6. The spring balance assembly of claim 5 further comprising a rotatable drum positioned between the spool and the coil spring.

7. A spring balance assembly for a sash window slidable within a master frame, the master frame having a channel, the spring balance assembly comprising:

a plate adapted to be attached to the master frame in the channel, the plate having a first portion and a second portion, wherein a first spool extends from the first portion and a second spool extends from the second portion;

a first coil spring having a coiled end and a free end, the coiled end rotatably supported by the first spool;

a second coil spring having a coiled end and a free end, the coiled end rotatably supported by the second spool;

a pivot brake assembly adapted to be attached to the sash window; and, a clip attached to the pivot brake assembly, the free end of the first and second coil springs connected to the clip.

8. The spring balance assembly of claim 7 wherein the clip has an attaching element that engages an aperture in the free end of the first spring.

9. The spring balance assembly of claim 8 wherein a nose region of the clip has an aperture and wherein a fastener is inserted through the aperture to connect the clip and the free end of the second spring to the pivot brake assembly.

10. The spring balance assembly of claim 9 wherein the nose region of the clip is received by a recess in the pivot brake assembly.

11. The spring balance assembly of claim 7 wherein the clip has a first attaching element that engages an aperture in the free end of the first spring and a second attaching element that engages an aperture in the free end of the second spring.

12. The spring balance assembly of claim 11 wherein a nose region of the clip has an aperture and wherein a fastener is inserted through the aperture to connect the clip to the pivot brake assembly.

13. The spring balance assembly of claim 12 wherein the nose region of the clip is received by a recess in the pivot brake assembly.

14. The spring balance assembly of claim 7 further comprising a rotatable drum positioned between the first spool and the first coil spring.

15. The spring balance assembly of claim 14 further comprising a rotatable drum positioned between the second spool and the second coil spring.

16. A clip for use with a spring balance assembly and a sash window, the sash window slidable within a channel ofamasterframe, the spring balance assembly having a plate affixed to the master frame in the channel, a coil spring rotatably supported by the plate and having a coiled and free end, and a pivot brake assembly attached to a portion of the sash window, the clip comprising:

a body having an attaching finger that engages the free end of the coil spring, and further having a nose region with an aperture that receives a fastener to connect the clip to the pivot brake assembly.

17. The clip of claim 16 wherein the body has a second attaching finger that engages an aperture in the free end of the coil spring.

18. A spring balance assembly for a sash window capable of sliding movement within a master frame, the spring balance assembly comprising:

a plate having a first portion and a second portion, the second portion being offset from the first portion to define a cavity;

a pivot brake assembly adapted to be connected to a lower portion of the sash window;

a first coil spring having a coiled end and a free end, the coiled end supported by the first portion, the free end connected to the pivot brake assembly; and, a second coil spring having a coiled end and a free end, the coiled end supported by the second portion, the free end connected to the pivot brake assembly.

19. The spring balance assembly of claim 18 further comprising a fastener inserted through an aperture in the free end and an aperture in the pivot brake assembly to connect the coil spring to the pivot brake assembly.

20. The spring balance assembly of claim 18 wherein the sash window includes hardware mounted to an upper portion of the sash window, the cavity accommodating the hardware during the sliding movement of the sash window.

21. The spring balance assembly of claim 20 wherein the hardware is a latch bolt that does not contact the first portion of the plate during the sliding movement of the sash window.

22. The spring balance assembly of claim 18 further comprising a transition portion positioned between the first and second portions, the transition portion defining a lower boundary of the cavity.

23. The spring balance assembly of claim 22 wherein the transition portion is generally perpendicular to the first and second portions thereby causing the plate to have a staggered configuration.

24. A spring balance assembly for a sash window capable of sliding movement within a master frame, the spring balance assembly comprising:

a plate having a first portion and a second portion, the second portion being offset from the first portion to define a cavity, wherein a first spool extends from the first portion and a second spool extends from the second portion;

a pivot brake assembly adapted to be connected to a lower portion of the sash window;

a first coil spring having a coiled end and a free end, the coiled end supported by the first spool, the free end connected to the pivot brake assembly;

a second coil spring having a coiled end and a free end, the coiled end supported by the second spool, the free end connected to the pivot brake assembly; and, a clip attached to the pivot brake assembly, the free end of the first coil spring connected to the clip and the free end of the second coil spring connected to the clip.

25. The spring balance assembly of claim 24 wherein the clip has an attaching element that engages an aperture in the free end of the first spring.

26. The spring balance assembly of claim 25 wherein a nose region of the clip has an aperture and wherein a fastener is inserted through the aperture to connect the clip and the free end of the second spring to the pivot brake assembly.

27. The spring balance assembly of claim 26 wherein the nose region of the clip is received by a recess in the pivot brake assembly.

28. The spring balance assembly of claim 24 wherein the clip has a first attaching element that engages an aperture in the free end of the first spring and a second attaching element that engages an aperture in the free end of the second spring.

29. The spring balance assembly of claim 28 wherein a nose region of the clip has an aperture and wherein a fastener is inserted through the aperture to connect the clip to the pivot brake assembly.

30. The spring balance assembly of claim 29 wherein the nose region of the clip is received by a recess in the pivot brake assembly.

31. The spring balance assembly of claim 24 wherein the sash window includes hardware mounted to an upper portion of the sash window, the cavity accommodating the hardware during the sliding movement of the sash window.

32. The spring balance assembly of claim 31 wherein the hardware is a latch bolt that does not make contact with the first portion of the plate during the sliding movement.

33. A spring balance assembly for a sash window capable of sliding movement within a master frame, the spring balance assembly comprising:

a plate having a first portion and a second portion, the second portion being offset from the first portion to define a cavity, wherein a first spool extends from the first portion and a second spool extends from the second portion;

a pivot brake assembly adapted to be connected to a lower portion of the sash window and having opposed first and second walls;

a first coil spring having a coiled end and a free end, the coiled end supported by the first spool, the free end connected to the first wall of the pivot brake assembly;

a second coil spring having a coiled end and a free end, the coiled end supported by the second spool, the free end connected to the second wall of the pivot brake assembly.

34. The spring balance assembly of claim 33 wherein a first fastener is used to connect the first spring to the first wall and a second fastener is used to connect the second spring to the second wall.

35. The spring balance assembly of claim 34 wherein the upper portion of the first wall has a recess, the free end of the first spring connected to the first wall at the recess with the fastener.

36. The spring balance assembly of claim 35 wherein the upper portion of the second wall has a recess, the free end of the second spring connected to the second wall at the recess with the fastener.

37. A spring balance assembly for a sash window capable of sliding movement within a master frame, a pivot brake assembly connected to a lower portion of the sash window; the spring balance assembly comprising:

a plate having a first portion residing in a first plane, the plate further having a second portion residing in a second plane, wherein the first and second planes are aligned;

a first coil spring having a coiled end and a free end, the coiled end supported by the first portion, the free end adapted to be connected to the pivot brake assembly; and, a second coil spring having a coiled end and a free end, the coiled end supported by the second portion, the free end adapted to be connected to the pivot brake assembly. of the sash window.

* * * * *

UNITED STATES PATENT AND TRADEMARK OFFICE

CERTIFICATE OF CORRECTION

PATENT NO. : 6,802,105 B2
APPLICATION NO. : 10/194445
DATED : October 12, 2004
INVENTOR(S) : Allen D. Polowinczak, Mark V. Murphy and James G. Prete It is certified that error appears in the above-identified patent and that said Letters Patent is hereby corrected as shown below:

Column 4, line 54, "21 a" should be -- 21a --

Column 10, line 7, "spooi" should be -- spool --

Column 10, line 57, "ofamasterframe" should be -- of a master frame --

Column 12, line 16, after "sliding movement" insert -- of the sash window --

Column 12, line 54, "aligned" should be -- misaligned --

Column 12 line 62, delete "of the sash window."

Signed and Sealed this

Seventeenth Day of October, 2006

JON W. DUDAS
*Director of the United States Patent and Trademark Office*